US007691235B2

(12) United States Patent
Lundgren

(10) Patent No.: US 7,691,235 B2
(45) Date of Patent: Apr. 6, 2010

(54) APPARATUS AND METHOD FOR SEPARATING STEAM FROM PULP FIBERS

(75) Inventor: Baltsar Lundgren, Sundsvall (SE)

(73) Assignee: Metso Paper, Inc. (FI)

( * ) Notice: Subject to any disclaimer, the term of this patent is extended or adjusted under 35 U.S.C. 154(b) by 1185 days.

(21) Appl. No.: 10/532,882

(22) PCT Filed: Oct. 17, 2003

(86) PCT No.: PCT/SE03/01614

§ 371 (c)(1),
(2), (4) Date: Nov. 7, 2005

(87) PCT Pub. No.: WO2004/040058

PCT Pub. Date: May 13, 2004

(65) Prior Publication Data

US 2006/0225853 A1 Oct. 12, 2006

(30) Foreign Application Priority Data

Oct. 29, 2002 (SE) ..... 0203176

(51) Int. Cl.
*D21C 7/00* (2006.01)
*D21B 1/12* (2006.01)

(52) U.S. Cl. ..... 162/234; 162/23; 162/28; 241/244

(58) Field of Classification Search ..... 162/23, 162/28, 234; 241/244
See application file for complete search history.

(56) References Cited

U.S. PATENT DOCUMENTS 1,861,247 A * 5/1932 Stebbins ..... 209/712
3,993,463 A * 11/1976 Barr ..... 55/306

(Continued)

FOREIGN PATENT DOCUMENTS

SE 514 165 C2 1/2001

(Continued)

OTHER PUBLICATIONS

Eriksson Ulf, The best use of steam -Metso Paper's technology for mechanical steam sepearation is designed to give environmental and energy benfits, Feb. 2008, RISI, whole document especially Table 1.*

(Continued)

*Primary Examiner*—Eric Hug
*Assistant Examiner*—Anthony J Calandra
(74) *Attorney, Agent, or Firm*—Lerner, David, Littenberg, Krumholz & Mentlik, LLP

(57) ABSTRACT

Apparatus for separating steam from a mixture of steam and fibers is disclosed, comprising an elongated feeding compartment having an inlet and a feeding device for feeding a mixture through the inlet. The feeding device comprises a tubular section which is curved such that the mixture in the tubular section is separated under the influence of centrifugal forces in a heavy steam-less fraction of fibers in a outer layer and in a light fiber-free fraction of steam in a inner layer. The tubular section is arranged in such a way that a heavy fraction of fibers is fed through the inlet peripherally. The separated light fraction of steam is fed against the center of the compartment and removed through an outlet of the apparatus.

8 Claims, 2 Drawing Sheets

U.S. PATENT DOCUMENTS

Figure 1A:
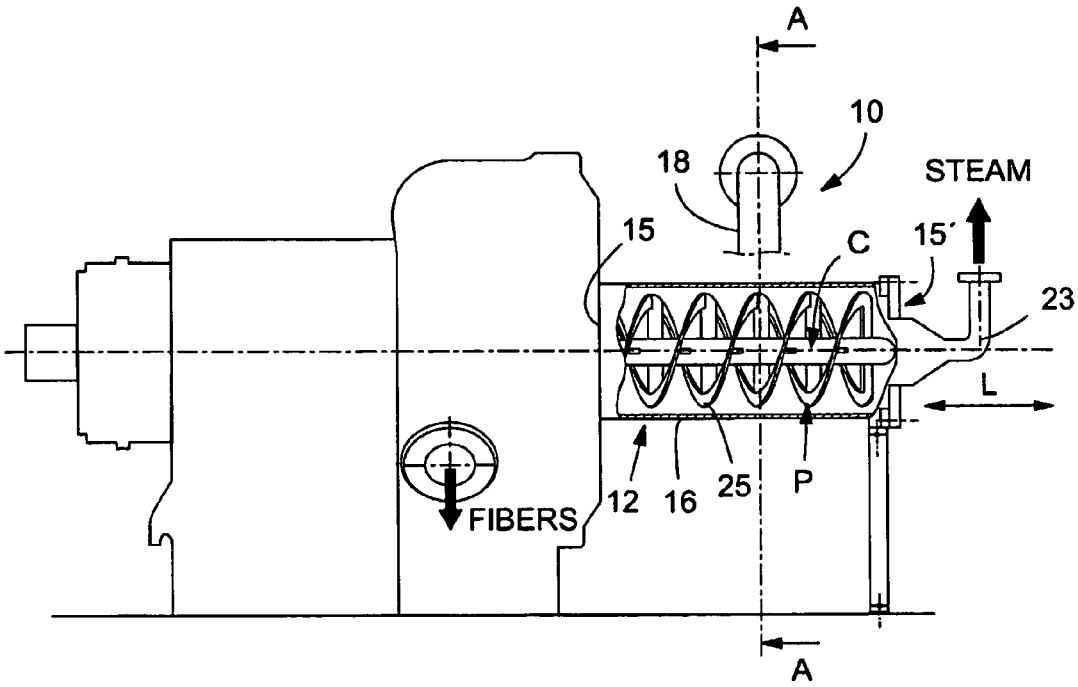

| | | | | |
|---|---|---|---|---|
| 4,260,401 | A | 4/1981 | Solymes | |
| 4,409,008 | A | 10/1983 | Solymes | |
| 4,954,221 | A * | 9/1990 | Reinhall et al. | 162/261 |
| 5,034,099 | A * | 7/1991 | Nilsson | 162/261 |
| 6,343,909 | B1 * | 2/2002 | Springer et al. | 415/71 |
| 6,398,851 | B1 * | 6/2002 | Bose | 95/273 |

FOREIGN PATENT DOCUMENTS

| | | | |
|---|---|---|---|
| SU | 1074606 | A | 2/1984 |
| SU | 1215749 | A | 3/1986 |
| WO | WO-88/08050 | A1 | 10/1988 |

OTHER PUBLICATIONS

Danielsson et al., "Energy Recovery in TMP and CTMP Systems", Sunds Defibrator AB;s Marknadsforingsmaterial , (tryckt 1984).
Dongen et al., "The Application of Gas/Liquid Cyclones in Oil Refining", Transaction of the ASME, pp. 245-251, Jan. 1958.
Rietema et al., "Cyclones in the Industry", Elsevier Publishing Company, 1961.

* cited by examiner

APPARATUS AND METHOD FOR SEPARATING STEAM FROM PULP FIBERS

CROSS-REFERENCE TO RELATED APPLICATIONS

The present application is a national phase entry under 35 U.S.C. § 371 of International Application No. PCT/SE2003/001614, filed Oct. 17, 2003, published in Swedish, which claims priority from Swedish patent Application No. 0203176-3, filed Oct. 29, 2002, all of which are incorporated herein by reference.

The present invention relates to an apparatus for separating steam from a mixture of steam and fibres, feeding means for use in the apparatus, and also a method for supplying a mixture of steam and fibres to an apparatus for separating steam from a mixture of steam and fibres.

Conventionally, a mixture of steam and fibres is supplied to a cyclone that separates a fraction of steam from a fraction of fibres and supplies the fraction of fibres to a feeding machine for further transportation of the fraction of fibres to a refiner in production of pulp. The cyclone has an outlet arranged radially against the circumference of the feeding machine for supplying the fraction of fibres in a direction against the centre of feeding machine. Steam is removed from an outlet in the centre of the cyclone and the fraction of fibres is added to the feeding machine. The feeding machine comprises a conveyor worm that brought the fraction of fibres further to a refiner.

However, clogging of the cyclone is a problem, although there exists screening devices in the cyclone that should prevent this. One reason is that the loading of fibres is large in the lower part of the cyclone. The clogging also depends on that extractive matters, that are extremely sticky, adheres to the fibres and easily makes them to create deposits in the cyclone. Yet a problem is that the residence time for the fibres in the cyclone might be far too long, whereby the fibres becomes discoloured undesirably much before they reach the subsequent refiner stage. This results in an increased need for bleaching.

The present invention aims to accomplish a simple and improved separation of a mixture of fibres and steam, and thereby a more efficient and favourable feeding of fibres for further transportation to a refiner in production of pulp. Yet another object is to minimize the residence time of the fibres at separation of fibres and stem, and thereby avoid additional need for bleaching.

This object is achieved with the apparatus for separating steam from a mixture of steam and fibres according to the present invention. The apparatus comprises an elongated feeding compartment having an inlet arranged between the short sides of the elongated feeding compartment and feeding means for feeding a mixture of steam and fibres through said inlet. The feeding means comprises a tubular section which is curved such that the mixture of steam and fibres during passage in the tubular section is separated during influence of centrifugal forces in a substantially relatively heavy steam-less fraction of fibres in a radially outer layer and in a substantially light fibre-free fraction of steam in a radially inner layer. The tubular section is arranged in such a way that heavy fraction of fibres is fed through the inlet peripherally into the elongated feeding compartment of the apparatus, while the separated light fraction of steam is fed through the inlet against the centre of the elongated feeding compartment and removed through an outlet of the apparatus.

Through the design of the curved portion of the tubular section of the feeding means in accordance with the present invention, a more efficient and improved separation of fibres and steam can be done, without appreciably needing to change the design of apparatus. The invention makes it possible to totally eliminate the need for a cyclone for separation of steam and fibre, and also for supply of fibre to the apparatus. This results in that the residence time during transportation to subsequent refiner can be minimized, whereby the requirement for strengthened bleaching of the fibres can be avoided. Thus, according to the present invention the apparatus works as a combined feeding machine for fibres and simultaneously as a separator of steam.

Preferably, in an outer tubular portion of the feeding means, which outer portion is adjacent an opposite end compared to the end of the curved tubular section which is connected to the inlet, the feeding means has a substantially straight, linear and non-curved extension. The feeding means might extend substantially perpendicular to the longitudinal extension of the apparatus. However, the feeding means is suitably arranged with an inclined extension in relation to the longitudinal extension of the apparatus, which extension preferably forms an angle between 75-90°, and most preferable an angle between 80-85°, in relation to the longitudinal extension of the apparatus. The inlet of the feeding means is suitably arranged tangentially at the circumference of the apparatus. The inlet and the feeding means can have a circular, quadratic or rectangular cross-sectional area. Preferably, the cross-sectional area of the inlet and the feeding means is quadratic or rectangular. A length of the curved section is adapted such that the velocity difference, between the velocity of the fibres in the feeding means in relation to the velocity of the conveyor worm in the apparatus, is minimized.

As mentioned above, both fibre and steam are fed to the apparatus. The mixture of steam and fibres is separated at passage in the curved tubular section, whereby a substantial relatively heavy steam-less fibre fraction forms a radially outer layer at the inlet that is fed peripherally in the apparatus. A substantially light fibre-free fraction of steam forms, at a passage in the curved tubular section, a radially inner layer that at the inlet is fed against the centre of the apparatus. Then the steam is removed from the centre of the apparatus through an axial outlet, or alternatively, through a radially outlet, arranged at the apparatus. The fraction of fibres at the circumference of the apparatus is conveyed further by way of a conveyor worm, arranged axially in the apparatus, against a subsequent refiner.

In the case the steam is discharged through a radially outlet at the apparatus, this is done from a rear chamber arranged in the apparatus, where steam is flowing through a gap formed between the shaft of the apparatus and an inwards wall section radially extending from an inner surface in the apparatus.

The present invention also relates to a feeding means for use in an apparatus as defined above, for feeding a mixture of steam and fibres through the inlet of the apparatus. The feeding means comprises a tubular section which is curved such that the mixture of steam and fibres during passage in the tubular section is separated during influence of centrifugal forces in a substantially relatively heavy steam-less fraction of fibres in a radially outer layer and in a substantially light fibre-free fraction of steam in a radially inner layer. The feeding means according to the present invention can suitably be used as replacement of existing feeding means for feeding mixtures of fibres and steam to apparatuses, such as feeding machines, which are in operation today. Advantageous features of the feeding means in itself have been described above and are further explained in the following detailed description and in the appended claims.

The present invention also relates to a method for feeding a mixture of steam and fibres to an elongated feeding compartment of an apparatus for separating steam from a mixture of steam and fibres. The mixture of steam and fibres are fed via a feeding means through an inlet arranged between the short sides of the elongated feeding compartment. The feeding means comprises a tubular section which is curved, whereby the mixture of steam and fibres at passage in the tubular section is brought to separate during influence of centrifugal forces in a substantially relatively heavy steam-less fraction of fibres in a radially outer layer and in a substantially light fibre-free fraction of steam in a radially inner layer. The tubular section is arranged in such a way that heavy fraction of fibres is fed through the inlet peripherally into elongated feeding compartment of the apparatus, while the separated light fraction of steam is fed through the inlet against the centre of the elongated feeding compartment and removed through an outlet of the apparatus.

Figure 1B:
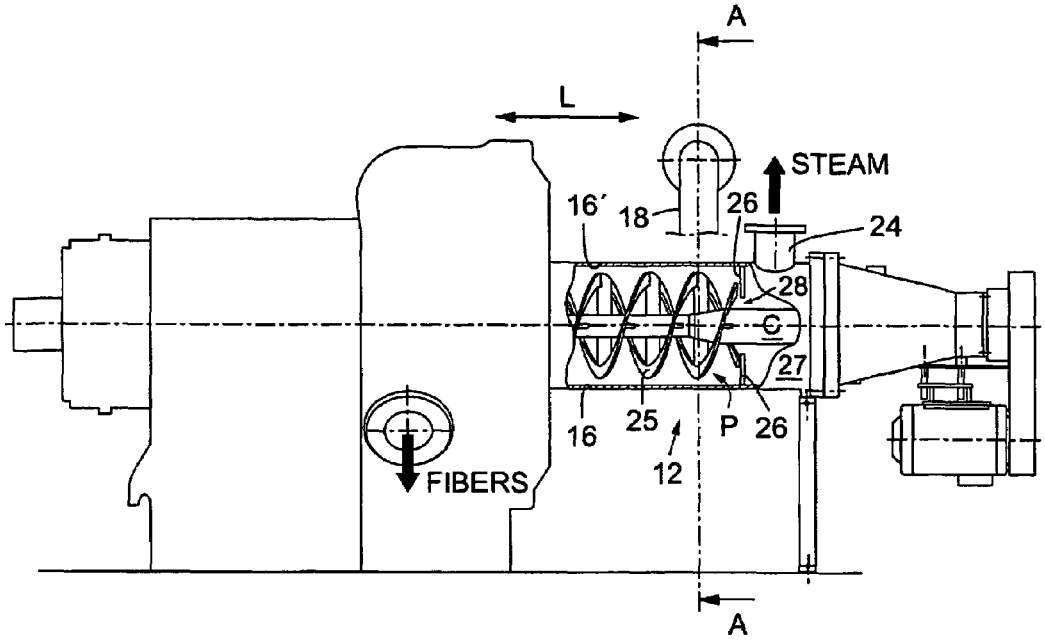
Figure 1C:
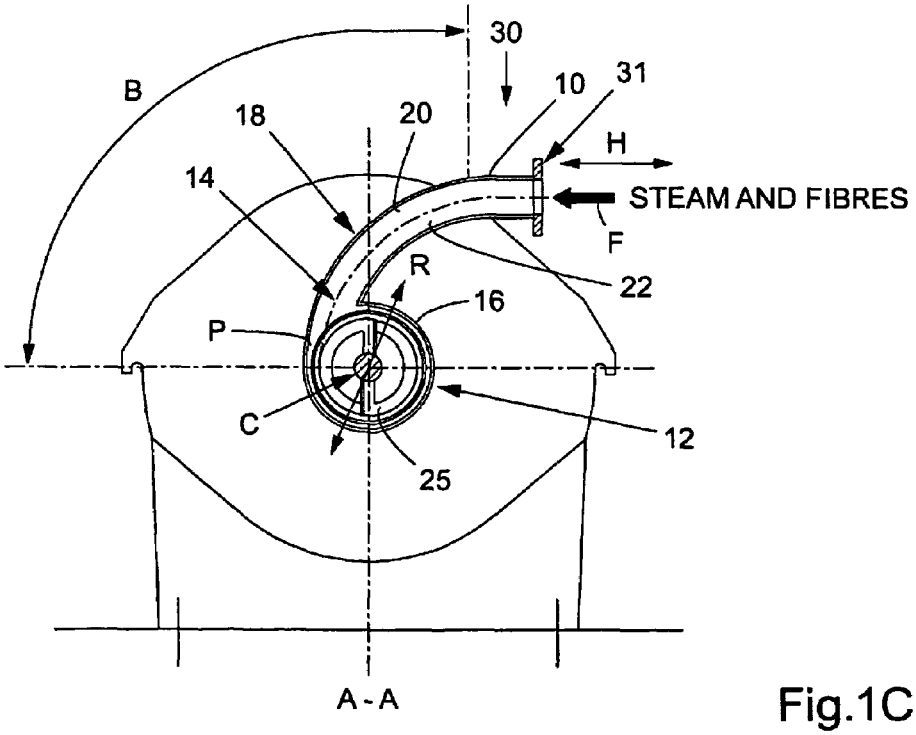

The present invention will now be described more detailed in embodiments, with reference to the accompanying drawings, without making a restricted interpretation of the invention thereto, where, FIG. 1A shows schematically an apparatus in a partly sectional longitudinal view, FIG. 1B shows schematically an apparatus in a partly sectional longitudinal view according to an alternative embodiment of the apparatus of FIG. 1A, and FIG. 1C shows the apparatus according to FIGS. 1A and 1B in a cross-section A-A.

Corresponding features of the embodiments illustrated in the FIGS. have been denoted with the same reference numerals.

FIG. 1A-C shows an apparatus comprising feeding means 10 for feeding a mixture of steam and fibres to an elongated feeding compartment 12 according to the present invention. The feeding means 10 is arranged to an inlet 14 at the circumference 16 of the compartment 12. The inlet 14 is arranged between the short sides 15, 15' of the elongated feeding compartment 12, through which inlet steam and fibres are fed to the compartment 12. The feeding means comprises a tubular section 18, which is curved. The curved tubular section is arranged directly adjacent to the inlet, in connection to the circumference 16 of the elongated feeding compartment 12. The tubular section extends substantially in the radial direction R of the elongated feeding compartment 12. The mixture of steam and fibres, at passage in the curved tubular section 18 is separated during influence of centrifugal forces, in a direction of flow F, in a substantially relatively heavy steam-less fraction of fibres in a radially outer layer 20 that at the inlet is fed peripherally P in the elongated feeding compartment 12, and in a substantially light fibre-free fraction of steam in a radially inner layer 22 that at the inlet is fed against the centre C of the elongated feeding compartment 12.

As evident from the embodiment of the feeding machine 12 in FIG. 1A, the steam that is brought towards the centre of the feeding machine is removed out through an axial outlet 23 arranged at the feeding machine. The fraction of fibres at the periphery of the feeding machine is conveyed further against a subsequent refiner, by way of a conveyor worm 25 arranged in the feeding machine The feeding means has an elongated outer tubular portion 30 (see FIG. 1C), which is adjacent an opposite end 31 compared to the end of the curved tubular section 18 that is connected to the inlet 14. Said outer tubular portion 30 has a substantially straight, linear non-curved extension H that, in the direction of flow F, passes into the curved section towards the inlet 14. The feeding means may extend substantially perpendicular to the longitudinal direction L of the elongated feeding compartment 12 of the apparatus, as shown in the drawings. However, the feeding means can suitably be arranged with a slightly obliquely extension in relation to the longitudinal extension of the apparatus. The inlet 14 is arranged tangentially at the periphery 16 of the elongated feeding compartment 12.

The curved tubular section 18 of the feeding means should have at least a curvature length that results in that all fibres that pass the straight outer portion 30 are caught by the curved section 18. The velocity of the fibres at the inlet may not be too high. By designing the curved section with a certain length of curvature, the curved section is thereby utilized to decrease the velocity of the fibres. Also the length B of the curved section is adapted such that the difference in velocity, between the velocity of the fibres in the feeding means in relation to the velocity of the conveyor worm in the elongated feeding compartment 12, is minimized. In order to provide for an effective separation of steam and fibres it is desirable, at ideal conditions, that a peripheral velocity for the fraction of steam and fibres at the inlet is substantially equal to the peripheral velocity of steam and fibres in the elongated feeding compartment 12.

FIG. 1B shows an alternative embodiment of the elongated feeding compartment 12 of the apparatus where the steam is removed through a radial outlet 24, instead of the axial outlet 23 in FIG. 1A. In that respect the apparatus of FIG. 1B comprises an inwards radially extending wall section 26 from an inner surface 16' in the elongated feeding compartment 12, that defines a rear chamber 27 arranged in the elongated feeding compartment 12 to which the radial outlet 24 is connected. The wall section is extending towards the shaft of elongated feeding compartment 12. There is a gap 28, between the outer end of the wall section and the shaft where the steam is flowing by and further out through the radial outlet 24. The fraction of fibres are fed in the opposite direction by means of the conveyor worm 25 and are restrained to be brought into the rear chamber by the wall section.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. Apparatus for separating steam from a mixture of steam and fibers, comprising an elongated feeding compartment including a pair of short sides, and having an inlet arranged between the pair of short sides of the elongated feeding compartment, a conduit configured for feeding a mixture of steam and fibers through said inlet, and a conveyor worm arranged axially in the feeding compartment for the feeding of fibers, said conduit comprising a curved conduit section which is curved such that the mixture of steam and fibers during passage in the curved conduit section is separated under the influence of centrifugal forces into a substantially relatively heavy steam-less fraction of fibers in a radially outer layer and into a substantially light fiber-free fraction of steam in a radially inner layer, the curved conduit section is arranged in such a way that a heavy fraction of fibers is fed through the inlet peripherally into the elongated feeding compartment of the apparatus, where the separated fraction of fibers are conveyed further by means of the conveyer worm, while the separated light fraction of steam is fed through the inlet against the center of the elongated feeding compartment and removed through an outlet of the apparatus.

2. Apparatus according to claim 1, wherein said curved conduit section is adapted such that the difference in velocity, between the velocity of the fibers in the conduit in relation to the velocity of the conveyor worm arranged in the elongated feeding compartment, is minimized.

3. Apparatus according to claim 1, further comprising an inwards radially extending wall section from an inner surface in the elongated feeding compartment, that defines a rear chamber in the apparatus to which the radial outlet is connected, through which outlet the steam is removed.

4. Apparatus according to claim 1, wherein the conduit has a substantially straight, linear elongated outer tubular portion, having an extension, which outer portion is positioned adjacent an opposite end compared to the end of the curved conduit section that is connected to the inlet.

5. Apparatus according to claim 4, wherein said extension of the conduit forms an angle between 75-90° in relation to the longitudinal extension of the apparatus.

6. Apparatus according to claim 1, wherein the inlet is arranged tangentially at the periphery of the apparatus.

7. Apparatus according to claim 1 wherein the cross-sectional area of the inlet and the conduit is quadratic or rectangular.

8. A method for feeding a mixture of steam and fibers to an elongated feeding compartment having a pair of short sides for apparatus for separating steam from a mixture of steam and fibers, where the mixture of steam and fibers are fed by a conduit through an inlet arranged between the short sides of the elongated feeding compartment, and where the fibers are conveyed further by means of a conveyor worm arranged axially in the feeding compartment, the conduit comprising a curved conduit section which is curved such that the mixture of steam and fibers during passage in the curved conduit section is brought to separate under the influence of centrifugal forces into a substantially relatively heavy steam-less fraction of fibers in a radially outer layer and into a substantially light fiber-free fraction of steam in a radially inner layer, the curved conduit section is arranged in such a way that heavy fraction of fibers is fed through the inlet peripherally into the elongated feeding compartment of the apparatus, where the separated fraction of fibers are conveyed further by means of the conveyer worm, while the separated light fraction of steam is fed through the inlet against the center of the elongated feeding compartment and removed through an outlet of the apparatus.

* * * * *